US008427909B2

(12) United States Patent
Takasawa

(10) Patent No.: US 8,427,909 B2
(45) Date of Patent: Apr. 23, 2013

(54) TIMEPIECE DIAL, METHOD OF MANUFACTURING A TIMEPIECE DIAL, AND A TIMEPIECE

(75) Inventor: Koki Takasawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 102 days.

(21) Appl. No.: 13/208,736

(22) Filed: Aug. 12, 2011

(65) Prior Publication Data

US 2012/0044788 A1 Feb. 23, 2012

(30) Foreign Application Priority Data

Aug. 19, 2010 (JP) ..... 2010-183954
Mar. 24, 2011 (JP) ..... 2011-066241

(51) Int. Cl.
*G04B 19/06* (2006.01)

(52) U.S. Cl.
USPC ..... 368/232; 368/205

(58) Field of Classification Search ..... 368/205, 368/223, 228, 232, 234, 280
See application file for complete search history.

(56) References Cited

U.S. PATENT DOCUMENTS

2008/0159083 A1 7/2008 Kawakami

FOREIGN PATENT DOCUMENTS

| | | | |
|---|---|---|---|
| EP | 1 852 754 | A1 | 11/2007 |
| JP | 11-326549 | A | 11/1999 |
| JP | 2006-220516 | A | 8/2006 |
| JP | 2008-051517 | A | 3/2008 |
| JP | 2008-185366 | A | 8/2008 |

OTHER PUBLICATIONS

European Search Report Application No. 11177761.1, Sep. 26, 2011.

*Primary Examiner* — Vit W Miska

(57) ABSTRACT

A timepiece dial has excellent transparency to electromagnetic waves (radio and light), and an excellent appearance, a timepiece dial manufacturing method enables manufacturing the timepiece dial, and a timepiece has the timepiece dial. The timepiece dial 1 has a substrate 2 that is electromagnetically transparent, and a dispersion film 3 containing a dispersion of metal powder 31 with an average particle diameter of 5 μm≦20 μm and an average particle thickness of 30 nm≦50 nm. The average thickness of the dispersion film 3 is 0.5 μm≦3.0 μm. The metal powder 31 is disposed with a specific gap therebetween in the through-thickness direction of the dispersion film 3.

15 Claims, 3 Drawing Sheets

TIMEPIECE DIAL, METHOD OF MANUFACTURING A TIMEPIECE DIAL, AND A TIMEPIECE

BACKGROUND

1. Technical Field

The present invention relates to a timepiece dial, a method of manufacturing a timepiece dial, and a timepiece.

2. Related Art

Dials used in solar timepieces (timepieces that have a photovoltaic cell) must have the ability (light transparency) to pass enough light for the solar cell to produce enough electromotive force (emf) for timepiece operations. Plastic parts with excellent transparency have therefore generally been used for dials in solar timepieces. Compared with metals such as Au and Ag, however, plastic lacks a sense of luxury and an attractive appearance. A dial that is manufactured by bonding metal foil with a hole therein to a plastic substrate by means of an adhesive attempts to solve this problem as taught in Japanese Unexamined Patent Appl. Pub. JP-A-11-326549 (particularly from line 35, right column, page 3 to line 11, left column, page 4).

A problem with this method, however, is that the metal foil is easily wrinkled when the foil is applied to the substrate. Preventing such wrinkles requires extreme care in the bonding process, resulting in extremely low productivity in dial manufacture. Furthermore, even when extreme care is used in the bonding process, completely preventing the creation of relatively small wrinkles, for example, is difficult, and obtaining a sufficiently outstanding appearance in the finished dial is difficult. Another problem with this method is that a relatively high percentage of the dials are determined to be no good, which is undesirable in terms of both production yield and resource conservation.

These problems are particularly severe when the metal foil is relatively thin (such as 10 μm or less). Furthermore, when the metal foil is relatively thin (such as 10 μm or less), the foil tears easily during the adhesion process. This is undesirable with respect to dial productivity, production cost, and resource conservation. In addition, parts of the torn metal foil may be dispersed into the air, which is a concern for worker health.

There have also been attempts to coat the entire surface of a substrate with a metal film using a vapor phase formation method to form a coating so thin that light passes through, but such extremely thin metal films cannot produce a metallic luster with a sufficiently luxurious appearance, and cannot produce an appearance with the quality desired for a dial or timepiece.

Radio-controlled timepieces that receive radio signals and adjust the time accordingly have also quickly become common. Excellent transmittance of electromagnetic waves (radio waves) by the dial and other members is therefore also required in such radio-controlled timepieces. Solar-powered radio-controlled timepieces that have both an internal solar cell and an internal antenna for signal reception are also becoming common. As described above, a balance between an excellent decorative appearance and excellent transmittance of electromagnetic waves is therefore also needed in the dials used in such timepieces, but achieving both characteristics is extremely difficult.

SUMMARY

An object of the present invention is therefore to provide a timepiece dial with both outstanding electromagnetic wave (radio and light) transmittance and an excellent appearance, a timepiece dial manufacturing method that enables suitably manufacturing the timepiece dial, and a timepiece having the timepiece dial.

A first aspect of the invention is a timepiece dial including: a substrate that is electromagnetically transparent; and a dispersion film in which metal powder with an average particle diameter of 5 μm≦20 μm and an average particle thickness of 30 nm≦50 nm is dispersed, the average thickness of the dispersion film is 0.5 μm≦3.0 μm, and the metal powder is disposed with a specific gap therebetween in the through-thickness direction of the dispersion film.

As a result, a timepiece dial that has excellent transparency to electromagnetic waves (radio and light) and an excellent appearance can be provided.

Another aspect of the invention is a timepiece dial in which the average gap between the metal powder in the through-thickness direction of the dispersion film is preferably 0.05 μm≦1.2 μm.

This enables rendering the entire timepiece dial with sufficiently outstanding electromagnetic transparency and a particularly outstanding appearance.

Another aspect of the invention is a timepiece dial wherein the light transmittance of the timepiece dial is 10%≦40%.

This enables suitably using light passing through the timepiece dial for power generation by a solar cell while rendering the timepiece dial with a sufficiently outstanding appearance. More specifically, the timepiece dial can be advantageously used in a solar timepiece with a solar cell.

In a timepiece dial according to another aspect of the invention, the area ratio of areas occupied by parts where the metal powder is not disposed when the timepiece dial is seen in plan view is 5%≦42%.

This enables rendering the entire timepiece dial with sufficiently excellent electromagnetic transparency and a particularly outstanding appearance.

Another aspect of the invention is a timepiece dial wherein at least the portion of the substrate that contacts the dispersion film is made of polycarbonate and/or acrylic resin; and the dispersion film includes acrylic resin and/or urethane resin.

The timepiece dial can therefore be rendered with particularly outstanding durability. In addition, the entire timepiece dial can be rendered with sufficiently excellent electromagnetic transparency and a particularly outstanding appearance.

Further preferably, the substrate of a timepiece dial according to another aspect of the invention has a coating layer composed of materials including a color agent disposed to the side of the substrate that contacts the dispersion film.

This helps further improve the appearance of the timepiece dial.

Another aspect of the invention is a timepiece dial manufacturing method including: a substrate preparation process that prepares a substrate that is electromagnetically transparent; and a dispersion application process that applies to the substrate a dispersion in which metal powder with an average particle diameter of 5 μm≦20 μm and an average particle thickness of 30 nm≦50 nm is dispersed, and forms on the substrate a dispersion film with an average thickness of 0.5 μm≦3.0 μm in which the metal powder is disposed with a specific gap therebetween in the through-thickness direction.

This aspect of the invention provides a timepiece dial manufacturing method that can appropriately manufacture a timepiece dial having excellent transparency to electromagnetic waves (radio and light) and an excellent appearance.

In a timepiece dial manufacturing method according to another aspect of the invention, the dispersion application process is preferably performed plural times.

This enables rendering the entire timepiece dial with sufficiently outstanding electromagnetic transparency and a particularly outstanding appearance.

In a timepiece dial manufacturing method according to another aspect of the invention, the dispersion application process is preferably done using a coating method.

This enables manufacturing the timepiece dials with particularly high productivity. In addition, the manufactured timepiece dials can be given a particularly outstanding appearance.

In a timepiece dial manufacturing method according to another aspect of the invention, the dispersion application process applies the dispersion from a direction inclined a specific angle from the normal to the substrate surface.

This enables giving the manufactured timepiece dials a particularly outstanding appearance.

In a timepiece dial manufacturing method according to another aspect of the invention, the specific angle is preferably $10° \leqq 60°$.

This enables giving the manufactured timepiece dials an even more outstanding appearance.

Further preferably in a timepiece dial manufacturing method according to another aspect of the invention, at least the portion of the substrate to which the dispersion is applied is made of polycarbonate and/or acrylic resin; and the dispersing medium of the dispersion includes one, or two or more, of a group including isopropyl alcohol, ethyl acetate, n-butyl acetate, isobutyl acetate, butyl cellosolve, and propylene glycol monomethylether acetate.

This enables giving the manufactured timepiece dials a particularly outstanding appearance.

Further preferably, a timepiece dial manufacturing method according to another aspect of the invention also has a heat process that heats the dispersion applied to the substrate after the dispersion application process.

This enables imparting the manufactured timepiece dial with particularly outstanding durability and reliability. In addition, the timepiece dials can be manufactured with particularly high productivity.

Another aspect of the invention is a timepiece having the timepiece dial of the invention.

This aspect of the invention provides a timepiece having a timepiece dial that has excellent transparency to electromagnetic waves (radio and light) and an excellent appearance.

A timepiece according to another aspect of the invention preferably also has a solar cell disposed on the back side of the timepiece dial.

This aspect of the invention enables appropriately using light passing the timepiece dial in a solar timepiece having the timepiece dial of the invention to produce power by means of a solar cell. In addition, while a solar cell disposed on the back side of the dial in a conventional timepiece adversely affects the overall appearance of the timepiece, a timepiece according to the invention having a solar cell disposed behind the timepiece dial can be rendered with a sufficiently pleasing appearance overall. More specifically, the effect of the invention is even more pronounced when used in a timepiece that has a solar cell disposed on the back side of the timepiece dial.

EFFECT OF INVENTION

The invention can provide a timepiece dial having outstanding transparency to electromagnetic waves (radio and light) and an outstanding appearance, provide a timepiece dial manufacturing method that enables suitably manufacturing the timepiece dial, and provide a timepiece having the timepiece dial.

DESCRIPTION OF EMBODIMENTS

Preferred embodiments of the present invention are described below with reference to the accompanying figures. It should be noted that the drawings referenced herein emphasize particular parts of the invention, and do not accurately reflect the dimensions, proportions, and other aspects of the actual configurations of the invention.

Timepiece Dial

Figure 1:
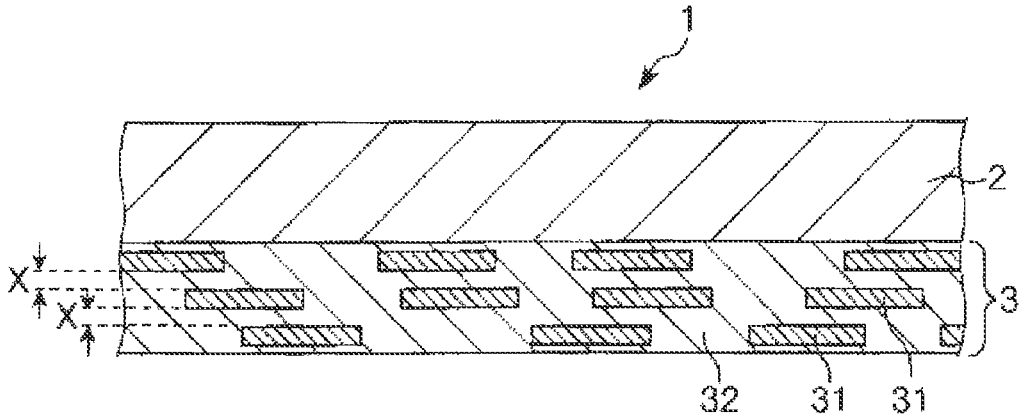
FIG. 1 is a section view schematically describing a preferred embodiment of a timepiece dial according to the invention.

FIG. 1 is a section view schematically describing a preferred embodiment of a timepiece dial according to the invention.

As shown in FIG. 1, the timepiece dial 1 according to this embodiment of the invention has a substrate (base) 2 and a dispersion film 3. The dispersion film 3 contains a dispersion of metal powder 31 with an average particle diameter of $5\ \mu m \leqq 20\ \mu m$ and an average particle thickness of $30\ nm \leqq 50\ nm$.

While either side of the timepiece dial 1 may face the observer (the outside) when assembled in the timepiece, this embodiment of the invention describes a configuration in which the top side as seen in FIG. 1 faces the observer (the outside) and the bottom side in FIG. 1 faces the inside of the timepiece. The side on the top in FIG. 1 is therefore referred to herein as the "top" and the side on the bottom in FIG. 1 is referred to as the "bottom."

Substrate (Base)

The substrate 2 is electromagnetically transparent, and has the ability to hold the dispersion film 3 containing metal powder 31 as described below.

Examples of materials that can be used for the substrate 2 include various plastic materials and various glass materials. The substrate 2 may also include a color agent or other components.

If made of plastic, the substrate 2 can be relatively easily shaped as desired. Plastic can also help reduce the total weight of the timepiece dial 1, and offers better impact resistance than glass.

If the substrate 2 is made of glass, the timepiece dial 1 can be rendered with outstanding light transparency.

The substrate 2 is preferably made of polycarbonate and/or acrylic resin. As a result, the timepiece dial 1 can be rendered with outstanding durability. In addition, the timepiece dial 1 can be rendered with sufficiently excellent electromagnetic transparency, and a particularly outstanding appearance. As a result, the timepiece dial 1 can be suitably used in a solar timepiece or radio-controlled timepiece.

In addition, if the dispersion film 3 described below includes acrylic resin and/or urethane resin, particularly outstanding adhesion can be achieved between the substrate 2 and dispersion film 3, and the durability in the timepiece dial can be further improved, if at least the part of the substrate 2 that contacts the dispersion film 3 is made of polycarbonate and/or acrylic resin.

The substrate 2 may be made with a uniform composition throughout, or with a different composition used in different parts. For example, the substrate 2 could have a base portion that is covered by a coating, and the coating may include a color agent, for example. This enables easily manufacturing plural types of timepiece dials indifferent colors by using a common base member for the base portion while changing the color agent contained in the coating as desired. The coating may be applied to the side that contacts the dispersion film 3, or to the top surface side.

If the coating made of materials including a color agent is disposed to the side of the substrate 2 that contacts the dispersion film 3, the appearance of the timepiece dial 1 can be further improved. More specifically, if this coating is disposed to the surface that contacts the dispersion film 3, the color of the timepiece dial 1 can be changed without impairing the function of the dispersion film 3 described below. In addition, because the colored coating will appear to the user to have been rendered in unison with the dispersion film 3 when the timepiece dial 1 is seen from the outside, the appearance of the timepiece dial 1 can be further improved.

The shape and size of the substrate 2 are not specifically limited, and are usually determined based on the shape and size of the timepiece dial 1. Furthermore, the substrate 2 (dial substrate) is flat in the configuration shown in the figure, but may be curved, for example.

The average thickness of the substrate 2 is preferably 200 μm≦700 μm, and further preferably is 300 μm≦600 μm. If the average thickness of the substrate 2 is in this range, increasing the thickness of the timepiece in which the timepiece dial 1 is used can effectively be prevented while sufficiently excellent mechanical strength and shape stability can be achieved in the timepiece dial 1.

The substrate 2 may be produced using any appropriate method, including compression molding and injection molding. The surface of the substrate 2 may also be processed to achieve the desired finish, including a mirror, brushed, or satinized surface. This enables varying the feel of the resulting timepiece dial 1, and enables further improving the appearance of the timepiece dial 1.

Dispersion Film

A dispersion film 3 having metal powder 31 dispersed in a solid dispersing medium 32 is disposed to the surface of the substrate 2.

The dispersion film 3 contains a dispersion of metal powder 31 with an average particle diameter of 5 μm≦20 μm and an average particle thickness of 30 nm≦50 nm, and the average thickness of the dispersion film 3 is 0.5 μm≦3.0 μm. This configuration reliably prevents the particles of the metal powder 31 from standing up in the dispersion film 3, and reliably renders the metal powder 31 particles in the dispersion film 3 substantially parallel to the surface of the dispersion film 3. This prevents the metal powder from scattering light, enables achieving a mirror surface, for example, and provides the timepiece dial 1 with an outstanding, luxurious appearance similar to a dial made of pure metal.

The metal powder 31 is disposed with a specific gap therebetween in the through-thickness direction of the dispersion film 3. This configuration renders an outstanding appearance as described above while also rendering the timepiece dial 1 with sufficiently excellent overall light transparency.

More specifically, by using a dispersion film 3 that satisfies the above conditions, the resulting timepiece dial 1 has outstanding transparency to electromagnetic waves (radio waves and light) together with an excellent appearance.

In addition, by using a dispersion film 3 that satisfies the above conditions, the resulting timepiece dial 1 has outstanding durability.

Furthermore, by rendering the timepiece dial 1 with a dispersion layer that satisfies the above conditions, there is no need for plating and therefore no plating solution waste to dispose of, and the environmental impact of manufacturing the timepiece dial can be reduced. Less energy is also required and productivity is improved because the substrates do not need to be individually plated.

These outstanding effects cannot be achieved when a simple metal plating layer is applied, or when an opening is formed in a metal foil using a mechanical method or a chemical method.

The average particle diameter of the metal powder 31 is 5 μm≦20 μm as described above, but is preferably 6 μm≦18 μm, and yet further preferably is 7 μm≦15 μm. This makes the effects described above particularly good.

Note that the average particle diameter as used herein denotes the diameter of a circle with the same area as the average area of the particles of the metal powder when seen in plan view.

As described above, the average thickness of the particles of the metal powder 31 is 30 nm≦50 nm, and more preferably is 35 nm≦45 nm. This further enhances the effect described above.

As also described above, the average thickness of the dispersion film 3 is 0.5 μm≦3.0 μm, more preferably is 0.6 μm≦2.2 μm, and yet more preferably is 0.7 μm≦1.0 μm. This further enhances the effect described above.

As described above, metal powder 31 is disposed with a specific gap therebetween in the through-thickness direction of the dispersion film 3 in this timepiece dial 1, and the average gap X between metal powder 31 particles in the through-thickness direction of the dispersion film 3 is 0.05 μm≦1.2 μm, and is further preferably 0.1 μm≦1.1 μm. As a result, the entire timepiece dial 1 can be rendered with sufficiently excellent electromagnetic transparency and a particularly outstanding appearance.

When the timepiece dial 1 is seen in plan view, the percentage of the total area occupied by the portion where the metal powder 31 is disposed is preferably 5%≦42%. As a result, the entire timepiece dial 1 can be rendered with sufficiently excellent electromagnetic transparency and a particularly outstanding appearance. These conditions can be easily and dependably achieved by using a metal powder satisfying the above conditions to render a dispersion film of a specified thickness.

More specifically, when the light (visible light) transmittance of the substrate 2 is 50% or more, the percentage of the total area occupied by the portion where the metal powder 31 is not disposed is preferably 5%≦26%. When the light transmittance of the substrate 2 is less than 50% (such as when the substrate 2 includes a color agent), the percentage of the total area occupied by the portion where the metal powder 31 is not disposed is preferably 17%≦42%. The effect described above is particularly enhanced as a result.

The shape of the metal powder 31 when seen in plan view is not specifically limited, but is preferably rectangular and further preferably square. This enables rendering the timepiece dial 1 with a particularly outstanding appearance.

The metals that can be used to form the metal powder 31 include, for example, Fe, Cu, Zn, Ni, Mg, Cr, Mn, Mo, Nb, Al, V, Zr, Sn, Au, Pd, Pt, Ag, and alloys including at least one of these metals (such as bronze, brass, and nickel silver). Of these, Cu, Al, Au, Pt, and Ag are preferred. If the metal powder is made from a material such as these, the particular excellent characteristics of the specific materials (such as metallic luster) can be desirably reflected in the appearance of the timepiece dial 1, it is more difficult for the observer to notice that metal powder 31 is contained in the dispersion film 3, and the timepiece dial 1 can be easily made to appear as though it is made of solid metal. As a result, the timepiece dial 1 can be imparted with a particularly outstanding appearance.

The content ratio of the metal powder 31 in the dispersion film 3 is preferably 5 vol %≦40 vol %, further preferably 7 vol %≦35 vol %, and yet further preferably 10 vol %≦33 vol %. If the content of the metal powder 31 in the dispersion film 3 is within this range, sufficiently outstanding adhesion with the substrate 2 of the dispersion film 3 can be achieved, the timepiece dial 1 can be rendered with excellent durability, and the timepiece dial 1 can be rendered with a particularly outstanding appearance and electromagnetic transparency.

The dispersing medium 32 of the dispersion film 3 is a solid, and functions to disperse the metal powder 31.

The dispersing medium 32 is made from an electromagnetically transparent (light transparency and radio frequency transparency) material, is preferably made from a resin material, and is further preferably made from a hardened cured resin. This provides particularly outstanding adhesion with the substrate 2 of the dispersion film 3, and provides the timepiece dial 1 with particularly outstanding durability.

If at least the part of the substrate 2 that contacts the dispersion film 3 is made of polycarbonate and/or acrylic resin, the dispersion film 3 preferably contains acrylic resin and/or urethane resin as the dispersing medium. This provides particularly outstanding adhesion between the substrate 2 and dispersion film 3, and renders the timepiece dial 1 with particularly outstanding durability.

The light (visible light) transmittance of the timepiece dial 1 is preferably 10%≦40%, further preferably 12%≦35%, and yet further preferably 15%≦30%. This enables suitably using the timepiece dial 1 in a solar timepiece with a photovoltaic cell. More specifically, light passing through the timepiece dial 1 can be desirably used by the solar cell to produce power while the timepiece dial 1 can be rendered with a particularly outstanding appearance.

The timepiece dial 1 in this embodiment of the invention is used with the substrate 2 rather than the dispersion film 3 on the top (facing the observer). This results in the dispersion film 3 being seen through the light transparent substrate 2, and renders the timepiece dial 1 with particularly outstanding luster and depth. In addition, a pattern of desired lands and grooves, for example, can be easily rendered in the top of the substrate 2, and this can be desirably used to produce a variety of different designs. More specifically, the invention can be desirably used to manufacture a wide variety of goods.

Method of Manufacturing the Timepiece Dial

A preferred embodiment of a timepiece dial manufacturing method that can be used to suitably manufacture the timepiece dial described above is described below.

Figure 2:
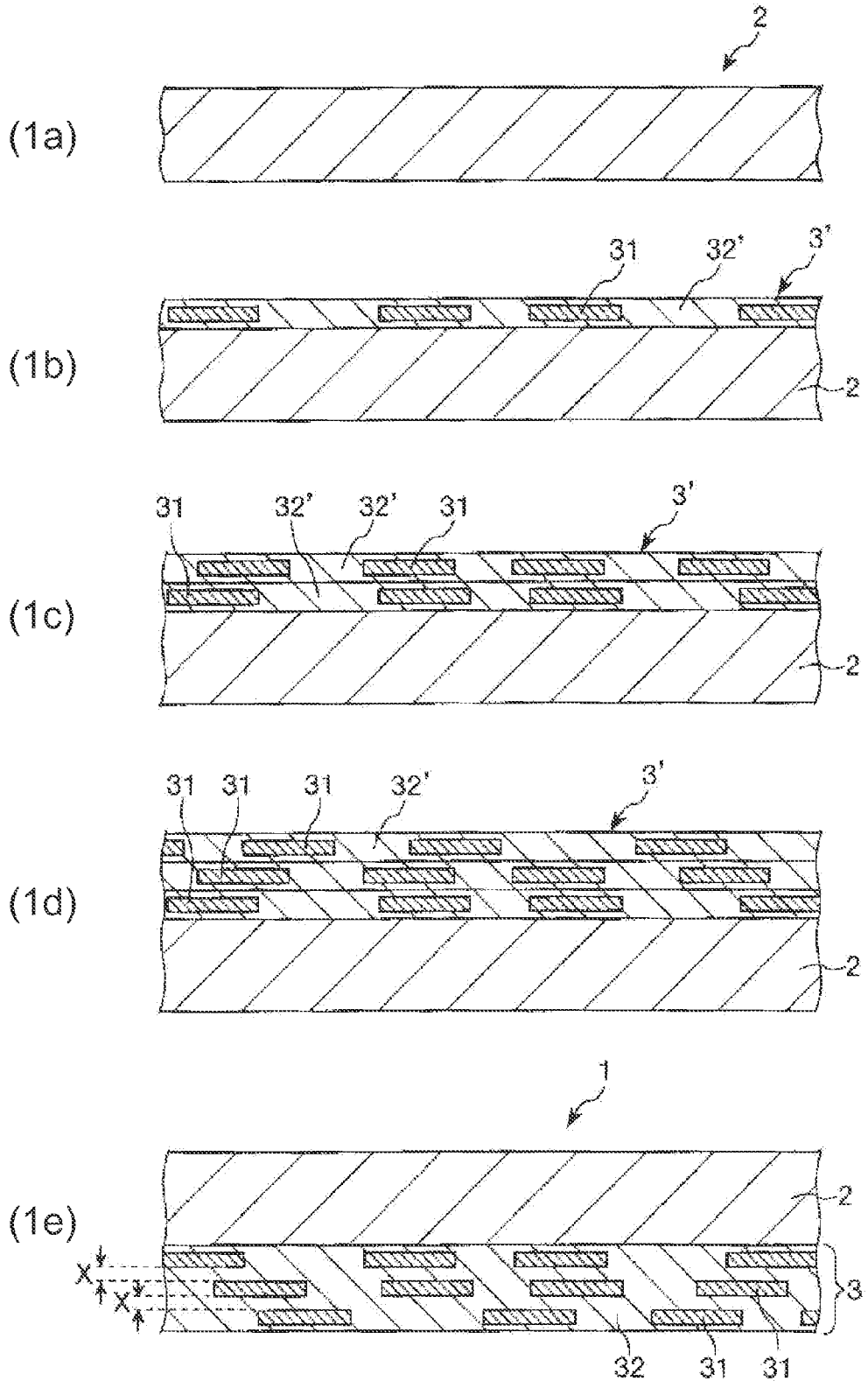
FIG. 2 is a section view schematically describing a preferred embodiment of a method of manufacturing a timepiece dial according to the invention.

FIG. 2 is a section view schematically describing this preferred embodiment of a timepiece dial manufacturing method according to the invention.

As shown in FIG. 2, the manufacturing method according to this embodiment of the invention includes a substrate preparation process (1*a*) that prepares an electromagnetically transparent substrate 2, and dispersion application process (1*b*, 1*c*, 1*d*) that applies a dispersion (composition) 3' of metal powder 31 having an average particle diameter of 5 μm≦20 μm and an average particle thickness of 30 nm≦50 nm to the surface of the substrate 2, and forms a dispersion film 3 with an average thickness of 0.5 μm≦3.0 μm in which metal powder 31 is disposed with a specific gap therebetween in the through-thickness direction on the substrate 2.

A timepiece dial 1 having excellent transparency to electromagnetic waves (radio frequency and light waves) and an excellent appearance can therefore be suitably manufactured.

More particularly, this embodiment of the invention also has a heat process that applies a heat processes after performing the dispersion application process (1*b*-1*d*) plural times.

Substrate Preparation Process

The substrate (dial substrate) 2 is prepared first (1*a*).

A workpiece such as described below can be used as the substrate 2.

The surface of the substrate 2 to which the dispersion 3' is applied is preferably smooth. This enables more reliably disposing the particles of the metal powder 31 substantially parallel to the surface of the substrate 2, and enables rendering the resulting timepiece dial 1 with a reliably outstanding appearance.

More specifically, the surface of the substrate 2 on the side where the dispersion film 3 is formed preferably has a maximum peak-valley height Ry of ≦100 μm, further preferably ≦5 μm, yet further preferably ≦3 μm, and yet further preferably ≦2 μm. As a result, the above-described effects can be reliably achieved.

The surface roughness Rz of the substrate 2 on the side where the dispersion film 3 is formed is preferably ≦20 μm, further preferably ≦1.5 μm, yet further preferably ≦0.8 μm, and yet further preferably ≦0.3 μm. As a result, the above-described effects can be reliably achieved.

Lyophilic processing or lyophobic processing may be applied to part of the surface of the substrate 2. More specifically, lyophilic processing may be applied to the part of the substrate 2 where the dispersion 3' is disposed (the part where the dispersion film 3 is to be formed), and lyophobic processing may be applied to the parts of the substrate 2 other than where the dispersion 3' is disposed (the part where the dispersion film 3 is to be formed). This enables easily and reliably applying the dispersion 3' selectively to the desired parts of the substrate 2 in the dispersion application process described below. As a result, a dispersion film 3 with the desired shape and pattern can be more reliably formed on the timepiece dial 1. In addition, by lyophobically processing the part of the substrate 2 where the dispersion 3' is not disposed, the timepiece dial 1 can be rendered with particularly excellent reliability because soiling can be prevented from sticking to the resulting timepiece dial 1.

A cleaning process may also be applied to the surface of the substrate 2 before the steps described below. This can enable particularly outstanding adhesion between the substrate 2 and the dispersion 3' (dispersion film 3), for example.

Dispersion Application Process

A dispersion 3' containing metal powder 31 and a liquid dispersing medium 32' is then applied to the surface of the substrate 2 (1*b*-1*d*).

More specifically, the dispersion application process repeats (1*b*-1*d*) in this embodiment of the invention. By performing the dispersion application process plural times, the desired gap between metal powder 31 in the through-thickness direction can be reliably achieved in the dispersion film 3, and the resulting timepiece dial 1 can be imparted with particularly outstanding transparency to electromagnetic waves. In addition, the particles of the metal powder 31 in the dispersion film 3 can more reliably be disposed substantially parallel to the surface of the dispersion film 3, and the manufactured timepiece dial 1 can be rendered with a particularly outstanding appearance.

While the dispersion application process is repeatedly performed three times (1*b*-1*d*) in the configuration shown in the figure, the number of times the dispersion application process is applied is not specifically limited but is preferably performed 2≦7 times, and further preferably 2≦5 times. This enables even better balancing further improving the electromagnetic transparency and decorativeness of the manufactured timepiece dial 1 with achieving outstanding productivity in timepiece dial 1 manufacture.

Any desired method may be used in the dispersion application process, but a coating method (particularly spray coating), is preferred. This enables achieving particularly outstanding productivity in timepiece dial 1 manufacture, and a particularly outstanding appearance in the manufactured timepiece dial 1.

The dispersion application process preferably applies the dispersion 3' from a direction inclined a specific angle to the normal of the substrate 2. This enables more reliably disposing the particles of the metal powder 31 of the dispersion film 3 substantially parallel to the surface of the dispersion film 3, and as a result enables rendering the manufactured timepiece dial 1 with a particularly outstanding appearance.

This specific angle is preferably 10°≦60° and further preferably 15°≦50°. This enables further dependably disposing the particles of the metal powder 31 of the dispersion film 3 substantially parallel to the surface of the dispersion film 3, and as a result enables rendering the manufactured timepiece dial 1 with a particularly outstanding appearance.

When at least the portion of the substrate 2 to which the dispersion 3' is applied is made of polycarbonate and/or acrylic resin, the dispersing medium 32' of the dispersion 3' preferably includes one or two or more of a group including isopropyl alcohol, ethyl acetate, n-butyl acetate, isobutyl acetate, butyl cellosolve, and propylene glycol monomethylether acetate, and further preferably includes ethyl acetate, n-butyl acetate, isobutyl acetate, butyl cellosolve, and propylene glycol monomethylether acetate. This enables suitably softening the near-surface region of the substrate 2 and rendering the surface of the substrate 2 (the surface that contacts the dispersion film 3) used to manufacture the timepiece dial 1 with suitable flatness. As a result, an outstanding appearance can be achieved in the manufactured timepiece dial 1. Particularly outstanding adhesion between the substrate 2 and dispersion film 3 can also be achieved, and the manufactured timepiece dial 1 can be rendered with particularly outstanding durability.

Furthermore, excellent productivity in timepiece dial 1 manufacture can be achieved because the liquid component of the dispersing medium 32' can be quickly removed from the dispersion 3' when manufacturing the timepiece dial 1. In addition, when the dispersion application process is repeated as in this embodiment of the invention, the orientation of the metal powder 31 particles contained in a layer formed in a previous dispersion application process can be prevented from changing as a result of the dispersion 3' applied in the next dispersion application process, and the particles of the metal powder 31 in the dispersion film 3 can more reliably be disposed substantially parallel to the surface of the dispersion film 3. As a result, the timepiece dial 1 can be more reliably rendered with an excellent appearance.

Heat Process

The dispersion 3' disposed to the substrate 2 is then heated (1*e*), resulting in a timepiece dial 1.

The manufactured timepiece dial 1 can be rendered with particularly outstanding durability and reliability by using this heat process. The productivity of timepiece dial 1 manufacture can also be made particularly outstanding.

More particularly, when the dispersion 3' contains a hardened resin, the heat process in this step can suitably harden the resin, giving the manufactured timepiece dial 1 particularly good durability and reliability.

In addition, when the dispersion 3' contains a liquid component that is commonly used as a solvent, the heat process in this step can reliably remove the liquid component and render the manufactured timepiece dial 1 with particularly good durability and reliability.

The heat temperature in this step is preferably 50° C.≦100° C., and further preferably 60° C.≦80° C. If the heat temperature is within this range, damage to the substrate 2, for example, can be effectively prevented, the effects described above can be reliably achieved, and the timepiece dial 1 can be manufactured with particularly high productivity.

Timepiece

A timepiece according to the invention has the timepiece dial of the invention described herein.

As described above, the timepiece dial of the invention has an excellent appearance. Of all of the parts that make up a timepiece, the timepiece dial draws the user's eyes and has a great effect on the overall appearance of the timepiece. A timepiece that incorporates the timepiece dial described above will therefore have an excellent general appearance.

As also described above, the timepiece dial according to this embodiment of the invention has excellent light transparency (electromagnetic transparency) and decorativeness (appearance). As a result, a timepiece that incorporates this timepiece dial sufficiently satisfies the conditions required for a solar timepiece.

More specifically, light passing the timepiece dial in a solar timepiece that incorporates the timepiece dial described above can be used appropriately to produce power by means of a solar cell. In addition, while a solar cell disposed on the back side of the dial in a conventional timepiece adversely affects the overall appearance of the timepiece, a timepiece according to the invention having a solar cell disposed behind the timepiece dial can be rendered with a sufficiently pleasing appearance overall. More specifically, the effect of the invention is even more pronounced when used in a timepiece that has a solar cell disposed on the back side of the timepiece dial.

Furthermore, because the timepiece dial of the invention also has excellent RF transparency (electromagnetic transparency), the timepiece dial can also be advantageously used in a radio-controlled timepiece.

Furthermore, other than the timepiece dial, parts known from the literature can be used in a timepiece according to the invention, but an example of the configuration of a timepiece according to the invention is described below.

Figure 3:
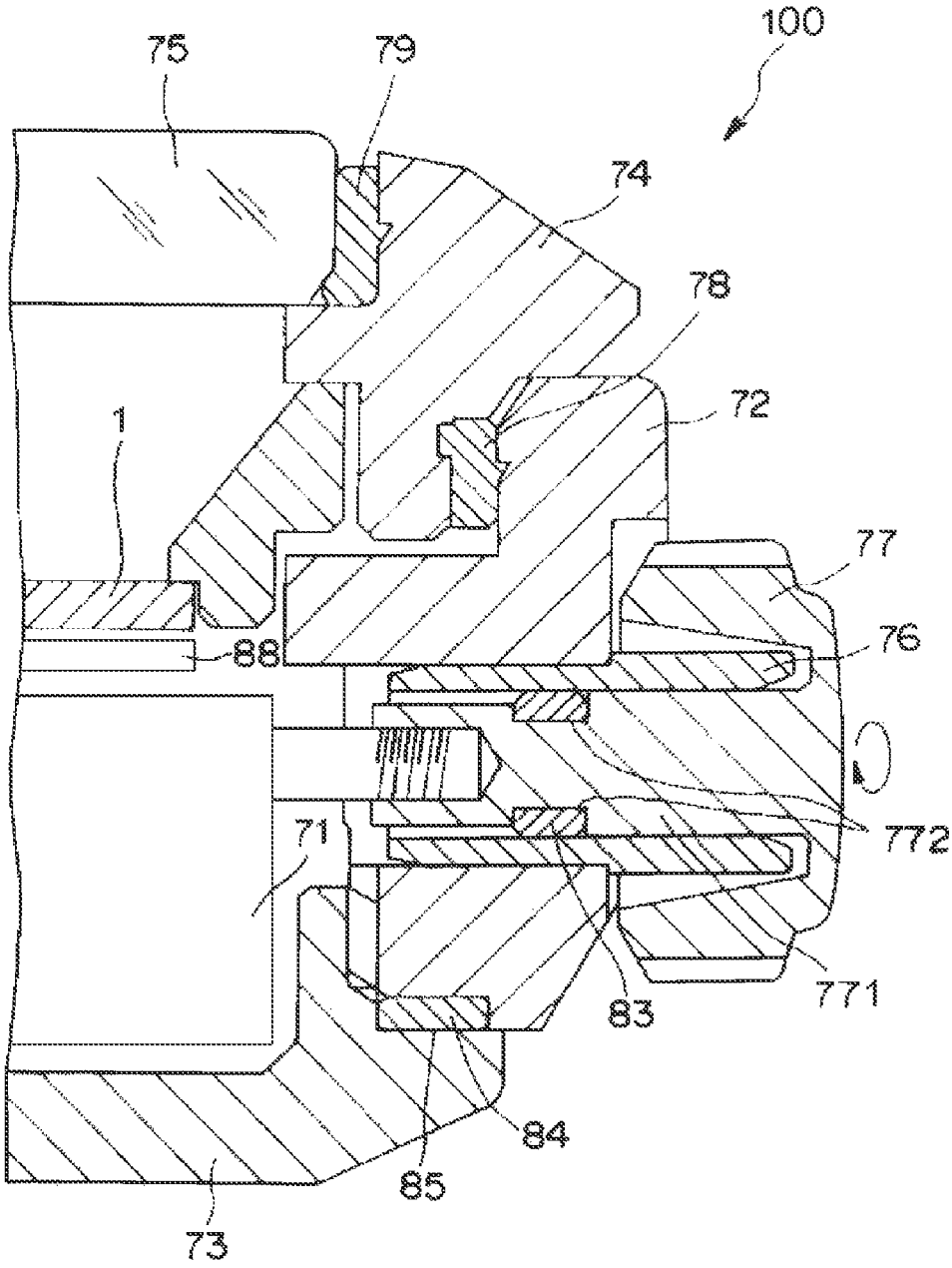
FIG. 3 is a section view schematically describing part of a timepiece (wristwatch) according to a preferred embodiment of the invention.

FIG. 3 is a schematic section view showing part of a preferred embodiment of a timepiece (portable timepiece) according to the invention.

As shown in FIG. 3, the wristwatch (portable timepiece) 100 according to this embodiment of the invention has a case 72, a back cover 73, a bezel 74, and a crystal 75. Inside the case 72 are the timepiece dial 1 described above, a solar cell 88, and a movement 71, as well as hands and other parts not shown.

The crystal 75 is normally made of transparent glass or sapphire, for example, with high transparency. As a result, the aesthetic of the timepiece dial 1 can be fully displayed and a sufficient amount of light can be incident to the solar cell 88.

The movement 71 drives the hands using electromotive force from the solar cell 88.

While not shown in FIG. 3, the movement 71 includes, for example, an electric double layer capacitor or lithium ion storage cell to store the electromotive force produced by the solar cell 88, a crystal oscillator as a reference time source, a semiconductor chip that produces drive pulses to drive the timepiece based on the oscillation frequency of the crystal oscillator, a stepper motor that drives the wheel train and hands every second when the drive pulse is applied, and a wheel train that transfers stepper motor movement to the hands.

The movement 71 also includes an antenna not shown for receiving radio signals, and a function for adjusting the time using the received signals.

The solar cell 88 functions to convert light energy to electric energy. The electric energy produced by the solar cell 88 is used to drive the movement, for example.

The solar cell 88 has, for example, a p-i-n structure having p-type impurities and n-type impurities selectively introduced to single crystal silicon thin-films, and an i-type single crystal silicon thin-film with a low impurity concentration sandwiched between the p-type single crystal silicon thin-film and the n-type single crystal silicon thin-film.

A winding pipe 76 is press-fit and secured in the case 72, and the stem 771 of the crown 77 is rotatably inserted in the winding pipe 76.

The case 72 and bezel 74 are secured by plastic packing 78, and the bezel 74 and crystal 75 are secured by plastic packing 79.

The back cover 73 is press-fit (or threaded) to the case 72 with a rubber O-ring (back cover packing) 84 compressed therebetween at the connection (seal joint) 85. This renders a liquid-tight seal at the seal joint 85, and provides water resistance.

A groove 772 is formed around the outside of the middle of the stem 771 of the crown 77, and a rubber O-ring (crown packing) 83 is fit into this groove 772. The rubber packing 83 fits tight to the inside surface of the winding pipe 76, and is compressed between this inside surface and the inside surface of the groove 772. This forms a liquid tight seal between the crown 77 and winding pipe 76, and provides water resistance. Note that when the crown 77 is rotated, the rubber packing 83 rotates with the stem 771, and slides circumferentially while remaining in contact with the inside surface of the winding pipe 76.

Note that this embodiment of the invention describes a wristwatch (portable timepiece) as an example of a timepiece, but the invention can be similarly applied to portable timepieces other than wristwatches, table clocks, wall clocks, and other types of timepieces.

Preferred embodiments of the invention are described above, but the invention is not limited thereto.

For example, the timepiece dial according to the invention is not limited to being manufactured using the method described above.

Steps other than those described above can also be used when manufacturing the timepiece dial of the invention. For example, a step of forming a coating layer may also be included. This enables adjusting the color or tone to further improve the appearance of the timepiece dial, or to improve other characteristics that are desirable in a timepiece dial, including weather resistance, water resistance, oil resistance, scratch resistance, wear resistance, and resistance to discoloration. Note, further, that this coating may be removed when the timepiece dial is used, for example. A step of forming an intermediate layer may also be included.

Furthermore, the foregoing embodiment describes a typical configuration in which the dispersion film is formed over all of one side of the substrate, but the dispersion film may be disposed to only part of the substrate. The dispersion film in this case may function as a marking (something that helps the user recognize the time, the orientation of the timepiece, functions of the timepiece, the timepiece brand, model, or other information). The dispersion film may also be disposed to both sides of the substrate.

EXAMPLES

Specific examples of the invention are described below.

1. Manufacturing a Timepiece Dial

Using the methods described below, 100 timepiece dials were manufactured as embodiments of the invention and 100 timepiece dials were manufactured as comparison samples.

Embodiment 1

A substrate with the shape of a timepiece dial was manufactured from polycarbonate by compression molding, and was then cut and polished as needed. The resulting substrate was substantially round with an approximately 27 mm diameter and approximately 0.5 mm thickness (substrate preparation process). The maximum peak-valley height Ry of the substrate surface is ≦100 μm and was ≦2 μm. In addition, the surface roughness Rz of the substrate surface is ≦20 μm and was ≦0.3 μm.

This substrate is then cleaned. The substrate was cleaned by dipping in an alkaline degreasing solution for 30 seconds followed by neutralization for 10 seconds, a water wash for 10 seconds, and a demineralized water wash for 10 seconds.

A dispersion containing Al powder (metal powder) with square particles when seen in plan view was then formed three times on one side of the cleaned substrate by spray coating (dispersion application process).

Spray coating was performed to apply the dispersion from an angle inclined 45° from the normal to the substrate surface.

The dispersion was formed using a composition including 1 wt % Al powder (40 nm average particle thickness, 10 μm average particle diameter), 1 wt % acrylic resin, 1 wt % isopropyl alcohol, 40 wt % ethyl acetate, 20 wt % n-butyl acetate, 2 wt % isobutyl acetate, 5 wt % propylene glycol monomethylether acetate, and 30 wt % butyl cellosolve.

The target coating thickness per application was 0.3 μm, and after spray coating was completed three times as described above, the dispersion-coated substrate was heated at 60° C. for 30 minutes (heat process). This resulted in a timepiece dial. The average thickness of the dispersion film was 0.9 μm. The average gap between Al powder through the thickness of the dispersion film was 0.3 μm.

The thickness of the substrate, dispersion film, and metal powder was measured using the microscopic cross-sectional test method described in JIS H 5821.

Embodiments 2 to 10

Timepiece dials were manufactured in the same way as in embodiment 1 except for changing the composition of the dispersion used to make the dispersion film, the composition of the substrate, and the conditions of the dispersion application process and heat process as shown in Table 1.

Embodiment 11

A timepiece dial was manufactured identically to the timepiece dial of embodiment 4 described above except for using a polycarbonate substrate (approximately 27 mm diameter, approximately 0.45 mm thick) with a coating (approximately 27 mm diameter, approximately 0.05 mm thick) made of acrylic resin and iron oxide as a pigment, and forming the dispersion film on the surface of this substrate coating.

Embodiments 12-20

A timepiece dial was manufactured in the same way as the timepiece dial of embodiment 11 described above except for changing the composition of the dispersion used to make the dispersion film, the composition of the substrate, and the conditions of the dispersion application process and heat process as shown in Table 1 and Table 2.

Comparisons 1 to 6

Timepiece dials were manufactured in the same way as in embodiment 1 except for changing the composition of the dispersion used to make the dispersion film, and the conditions of the dispersion application process as shown in Table 2.

Comparison 7

Identically to embodiment 1 above, a polycarbonate substrate with the shape of the timepiece dial to be manufactured was prepared, and this substrate was cleaned in the same way as in embodiment 1 above.

A timepiece dial was then manufactured by forming a 50 nm thick metal thin film of Al over all of one side of the substrate by a vacuum deposition method.

Comparison 8

A timepiece dial was manufactured in the same way as comparison 7 above except for changing the thickness of the metal thin film to 100 μm by changing the film formation time of the vacuum deposition process.

Comparison 9

A stainless steel panel with a flat surface was first prepared.

A resist film with an average thickness of 20 μm was then printed on the surface of this panel.

The resist film was then exposed using an exposure device and part of the resist film was then removed by a developing process, leaving plural round resist films (300 μm diameter).

A metal coating was then formed on the panel by sputtering. The metal coating was formed as follows.

First, the process chamber was vented (pressure reduced) to $3\times10^{-3}$ Pa, and argon was then introduced at a 35 ml/min gas flow rate. A metal coating made of Ag was then formed by discharging 1400 W for a 2.0 minute process time using Ag as the target. The average thickness of the resulting metal coating was 0.20 μm.

The remaining resist film was then removed from the stainless steel plate. After removing the resist, the panel coated with the resist film and metal coating was immersed for 5-10 minutes in an aqueous solution of sodium hydroxide for 30-40 minutes. As a result, a metal coating with a plurality of round openings was obtained. The diameter of the openings in the metal coating was 300 μm.

A polycarbonate substrate with the shape of the timepiece dial to be manufactured was also prepared in the same way as in embodiment 1 above, and this substrate was cleaned in the same way as in embodiment 1.

A timepiece dial was then obtained by applying an adhesive to the cleaned polycarbonate substrate, removing the metal coating with openings from the stainless steel panel, and bonding the metal coating to the substrate through the intervening adhesive. Care was taken to prevent the metal coating from tearing and to prevent wrinkles from forming in the metal coating bonded to the substrate, but tears resulted in some of the metal coatings when they were removed from the panel. Wrinkles that were produced when bonded to the substrate were also observed in numerous timepiece dials.

Comparison 10

A timepiece dial was manufactured in the same way as in comparison 9 above except that the openings in the metal coating were formed with a 5 μm diameter by changing the exposure conditions of the resist film.

The manufacturing conditions of the timepiece dial and the configurations of the timepiece dials in the embodiments and comparisons described above are summarized in Table 1 and Table 2.

Note that in the tables polycarbonate is abbreviated PC; acrylic resin, Ac; acrylonitrile-butadiene-styrene copolymer (ABS resin), ABS; polyurethane, PU; isopropyl alcohol, a; ethyl acetate, b; n-butyl acetate, c; isobutyl acetate, d; butyl cellosolve, e; propylene glycol monomethylether acetate, f; ethanol, g; and iron oxide used as pigment, Pig.

In addition, the gap between the metal powder through the thickness of the dispersion film is denoted X in the tables; the area ratio of the area occupied by parts where the metal powder is not disposed when the timepiece dial is seen in plan view is denoted Y; and the angle between the direction from which the dispersion is applied and the normal to the substrate in the dispersion application process is denoted θ.

TABLE 1

| | Manufacturing conditions | | | | | Timepiece dial | | |
|---|---|---|---|---|---|---|---|---|
| | | | | Heating process | | Substrate | | |
| | Dispersion application process | | | Heating | | | | Light |
| | Dispersing medium | θ [°] | Times done | Temp [° C.] | time [minutes] | Coated | Composition | transparency [%] |
| Embodiment 1 | Ac, a, b, c, d, e, f | 45 | 3 | 60 | 30 | no | PC | 90 |
| Embodiment 2 | Ac, a, b, c, d, e, f | 30 | 3 | 70 | 30 | no | PC | 90 |
| Embodiment 3 | Ac, a, b, c, d, e, f | 15 | 4 | 70 | 30 | no | Ac | 93 |
| Embodiment 4 | Ac, a, b, c, d, e, f | 45 | 3 | 80 | 30 | no | Ac | 93 |
| Embodiment 5 | Pu, a, bc | 0 | 3 | 70 | 30 | no | ABS | 90 |
| Embodiment 6 | PU, g | 70 | 3 | 70 | 30 | no | ABS | 90 |
| Embodiment 7 | Ac, a, b, c, d, e, f | 45 | 3 | 60 | 30 | no | PC | 90 |
| Embodiment 8 | Ac, a, b, c, d, e, f | 45 | 3 | 60 | 30 | no | PC | 90 |
| Embodiment 9 | Ac, a, b, c, d, e, f | 45 | 4 | 60 | 30 | no | PC | 90 |
| Embodiment 10 | Ac, a, b, c, d, e, f | 45 | 2 | 60 | 30 | no | PC | 90 |
| Embodiment 11 | Ac, a, b, c, d, e, f | 45 | 3 | 60 | 30 | yes | PC/Ac + Pig | 48 |
| Embodiment 12 | Ac, a, b, c, d, e, f | 30 | 3 | 70 | 30 | yes | PC/Ac + Pig | 48 |
| Embodiment 13 | Ac, a, b, c, d, e, f | 15 | 4 | 70 | 30 | yes | PC/Ac + Pig | 48 |
| Embodiment 14 | PU, g | 5 | 3 | 70 | 30 | yes | ABS/Ac + Pig | 48 |
| Embodiment 15 | Ac, a, b, c, d, e, f | 45 | 3 | 60 | 30 | yes | PC/Ac + Pig | 48 |

TABLE 1-continued

| | Timepiece dial | | | | | | | | | | |
|---|---|---|---|---|---|---|---|---|---|---|---|
| | Dispersion film | | | | | | | | | | |
| | Metal powder | | | | Dispersing medium | | Metal coating | | | | |
| | Comp | Avg particle diameter [μm] | Avg thick [nm] | Film content [vol %] | Composition | Avg. thick [μm] | Avg X [μm] | Avg thick [μm] | Open dia [μm] | Num. aperture [%] | Y [%] |
| Embodiment 1 | Al | 10 | 40 | 50 | Ac | 0.9 | 0.3 | — | — | — | 8 |
| Embodiment 2 | Al | 15 | 45 | 45 | Ac | 0.7 | 0.2 | — | — | — | 10 |
| Embodiment 3 | Ag | 7 | 35 | 50 | PU | 1.0 | 0.2 | — | — | — | 8 |
| Embodiment 4 | Al | 12 | 40 | 30 | Ac | 0.9 | 0.3 | — | — | — | 27 |
| Embodiment 5 | Al | 10 | 40 | 50 | PU | 0.9 | 0.3 | — | — | — | 8 |
| Embodiment 6 | Al | 10 | 40 | 50 | PU | 0.9 | 0.3 | — | — | — | 8 |
| Embodiment 7 | Al | 5 | 30 | 50 | Ac | 0.9 | 0.3 | — | — | — | 8 |
| Embodiment 8 | Al | 10 | 50 | 50 | Ac | 0.9 | 0.3 | — | — | — | 8 |
| Embodiment 9 | Al | 10 | 40 | 50 | Ac | 0.5 | 0.05 | — | — | — | 8 |
| Embodiment 10 | Al | 10 | 40 | 50 | Ac | 3.0 | 1.2 | — | — | — | 8 |
| Embodiment 11 | Al | 12 | 40 | 50 | Ac | 0.9 | 0.3 | — | — | — | 27 |
| Embodiment 12 | Al | 15 | 45 | 50 | Ac | 0.7 | 0.2 | — | — | — | 30 |
| Embodiment 13 | Ag | 7 | 35 | 45 | Ac | 1.0 | 0.2 | — | — | — | 17 |
| Embodiment 14 | Al | 10 | 40 | 50 | PU | 0.9 | 0.3 | — | — | — | 8 |
| Embodiment 15 | Al | 6 | 40 | 50 | Ac | 0.9 | 0.3 | — | — | — | 8 |

TABLE 2

| | Manufacturing conditions | | | | | Timepiece dial | | |
|---|---|---|---|---|---|---|---|---|
| | | | | Heating process | | Substrate | | |
| | Dispersion application process | | | | Heating | | | Light |
| | Dispersing medium | θ [°] | Times done | Temp [° C.] | time [minutes] | Coated | Composition | transparency [%] |
| Embodiment 16 | Ac, a, b, c, d, e, f | 45 | 3 | 60 | 30 | yes | PC/Ac + Pig | 48 |
| Embodiment 17 | Ac, a, b, c, d, e, f | 45 | 3 | 60 | 30 | yes | PC/Ac + Pig | 48 |
| Embodiment 18 | Ac, a, b, c, d, e, f | 45 | 3 | 60 | 30 | yes | PC/Ac + Pig | 48 |
| Embodiment 19 | Ac, a, b, c, d, e, f | 45 | 4 | 60 | 30 | yes | PC/Ac + Pig | 48 |
| Embodiment 20 | Ac, a, b, c, d, e, f | 45 | 2 | 60 | 30 | yes | PC/Ac + Pig | 48 |
| Comparison 1 | Ac, a, b, c, d, e, f | 45 | 3 | 60 | 30 | no | PC | 90 |
| Comparison 2 | Ac, a, b, c, d, e, f | 45 | 3 | 60 | 30 | no | PC | 90 |
| Comparison 3 | Ac, a, b, c, d, e, f | 45 | 3 | 60 | 30 | no | PC | 90 |
| Comparison 4 | Ac, a, b, c, d, e, f | 45 | 3 | 60 | 30 | no | PC | 90 |
| Comparison 5 | Ac, a, b, c, d, e, f | 45 | 3 | 60 | 30 | no | PC | 90 |
| Comparison 6 | Ac, a, b, c, d, e, f | 45 | 3 | 60 | 30 | no | PC | 90 |
| Comparison 7 | Ac, a, b, c, d, e, f | — | — | — | — | no | PC | 90 |
| Comparison 8 | Ac, a, b, c, d, e, f | — | — | — | — | no | PC | 90 |
| Comparison 9 | Ac, a, b, c, d, e, f | — | — | — | — | no | PC | 90 |
| Comparison 10 | Ac, a, b, c, d, e, f | — | — | — | — | no | PC | 90 |

| | Timepiece dial | | | | | | | | | | |
|---|---|---|---|---|---|---|---|---|---|---|---|
| | Dispersion film | | | | | | | | | | |
| | Metal powder | | | | Dispersing medium | | Metal coating | | | | |
| | Comp | Avg particle diameter [μm] | Avg thick [nm] | Film content [vol %] | Composition | Avg. thick [μm] | Avg X [μm] | Avg thick [μm] | Open dia [μm] | Num. aperture [%] | Y [%] |
| Embodiment 16 | Al | 18 | 40 | 50 | Ac | 0.9 | 0.3 | — | — | — | 8 |
| Embodiment 17 | Al | 10 | 33 | 50 | Ac | 0.9 | 0.3 | — | — | — | 8 |
| Embodiment 18 | Al | 10 | 48 | 50 | Ac | 0.9 | 0.3 | — | — | — | 8 |
| Embodiment 19 | Al | 10 | 40 | 50 | Ac | 0.6 | 0.05 | — | — | — | 8 |
| Embodiment 20 | Al | 10 | 40 | 50 | Ac | 1.5 | 0.6 | — | — | — | 8 |
| Comparison 1 | Al | 4.4 | 40 | 40 | Ac | 0.9 | 0.3 | — | — | — | 14 |
| Comparison 2 | Al | 21 | 40 | 60 | Ac | 0.9 | 0.3 | — | — | — | 7 |
| Comparison 3 | Al | 10 | 28 | 50 | Ac | 0.9 | 0.3 | — | — | — | 8 |
| Comparison 4 | Al | 10 | 53 | 50 | Ac | 0.9 | 0.3 | — | — | — | 8 |

TABLE 2-continued

| | | | | | | | | | | | |
|---|---|---|---|---|---|---|---|---|---|---|---|
| Comparison 5 | Al | 10 | 40 | 50 | Ac | 0.4 | 0.1 | — | — | — | 8 |
| Comparison 6 | Al | 10 | 40 | 50 | Ac | 3.1 | 0.8 | — | — | — | 8 |
| Comparison 7 | — | — | — | — | — | — | — | 50 | — | 0 | — |
| Comparison 8 | — | — | — | — | — | — | — | 100 | — | 0 | — |
| Comparison 9 | — | — | — | — | — | — | — | 200 | 300 | 55 | — |
| Comparison 10 | — | — | — | — | — | — | — | 200 | 5 | 32 | — |

2. Evaluation of Timepiece Dial Appearance

The timepiece dials manufactured according to the embodiments and comparisons described above were evaluated visually and by microscope, and the appearance was ranked according to the following five grades.

A: particularly outstanding

B: outstanding

C: good

D: some blemishes

E: unacceptable

3. Evaluation of Light Transparency of Timepiece Dial

The light transparency of the timepiece dials manufactured according to the embodiments and comparisons described above was evaluated by the following method.

A solar cell and each of the timepiece dials were placed in a darkroom. The solar cell was then directly exposed to light from a fluorescent light (Toshiba FL20S.D-EDL-D65 color evaluation lamp for color comparison and inspection) used as the light source disposed a specific distance from the light-receiving surface of the solar cell. The output current of the solar cell at this time was A (mA).

The timepiece dial was then placed on the light receiving surface of the solar cell, and exposed to light from the fluorescent light disposed at a specific distance as described above. The output current of the solar cell at this time was B (mA).

The light transparency of the timepiece dial was then calculated as (B/A)×100, and graded according to the five levels shown below. The light transparency of the timepiece dial can be said to improve as the light transmittance of the timepiece dial rises.

S: >30%

A: ≧18% and ≦30%

B: ≧17% and <18%

C: ≧15% and <17%

D: <15%

4. Evaluation of Radio Frequency Transparency

The radio frequency transparency of the timepiece dials manufactured according to the embodiments and comparisons described above was evaluated by the following method.

First, a timepiece case and an internal module for a wristwatch (a movement) having an antenna for RF reception was prepared.

The internal wristwatch module (movement) and the timepiece dial were then assembled in the timepiece case, and signal reception sensitivity was measured.

Using reception sensitivity when the timepiece dial is not installed as a reference, the drop (dB) in reception sensitivity when a timepiece dial was installed was evaluated according to the four levels shown below. The radio frequency transparency of the timepiece dial can be said to improve as the drop in signal reception sensitivity drops.

A: no sensitivity drop observed (below detection limit)

B: sensitivity drop<0.7 dB

C: 0.7 dB≦sensitivity drop<1.0 dB

D: sensitivity drop≧1.0 dB

5. Evaluation of Coating (Dispersion Film, Metal Coating) Adhesion

The adhesion of the coating (dispersion film, metal coating) on the timepiece dials manufactured according to the embodiments and comparisons described above was evaluated using the following two tests.

5-1 Bending Test

Each timepiece dial was bent 30° at the center of the timepiece dial around a 4 mm diameter steel rod, the appearance of the timepiece dial was then inspected visually, and the appearance was graded according to the following four levels. Bending was in both compression and stretching directions.

A: no lifting or separation of coating observed

B: substantially no lifting of coating observed

C: obvious lifting of coating observed

ID: clear cracking, separation of coating observed 5-2 Heat Cycle Test

The timepiece dials were submitted to a heat cycle test as described below.

The timepiece dial was left for 1.5 hr at 20° C., then 2 hr at 60° C., then 1.5 hr at 20° C., and then 3 hr at −20° C. The ambient temperature was then returned to 20° C., completing one cycle (8 hr). This cycle was repeated three times (total 24 hrs).

The appearance of the timepiece dial was then visually inspected, and the appearance was graded according to the following four levels.

A: no lifting or separation of coating observed

B: substantially no lifting of coating observed

C: obvious lifting of coating observed

D: clear cracking, separation of coating observed

The results of these tests are shown in Table 3.

TABLE 3

| | | | | Film adhesion | |
|---|---|---|---|---|---|
| | Appearance | Light transmittance | RF transmittance | Bending test | Heat cycle test |
| Embodiment 1 | A | A | A | A | A |
| Embodiment 2 | A | A | A | A | A |
| Embodiment 3 | A | A | A | A | A |
| Embodiment 4 | B | A | A | A | A |
| Embodiment 5 | C | A | A | B | B |
| Embodiment 6 | C | A | A | B | B |
| Embodiment 7 | B | A | A | A | A |
| Embodiment 8 | B | A | A | B | B |
| Embodiment 9 | B | A | A | B | B |
| Embodiment 10 | B | A | A | A | A |
| Embodiment 11 | A | A | A | A | A |
| Embodiment 12 | A | A | A | A | A |
| Embodiment 13 | A | A | A | A | A |
| Embodiment 14 | B | A | A | A | A |
| Embodiment 15 | B | A | A | A | A |
| Embodiment 16 | B | A | A | B | B |
| Embodiment 17 | B | A | A | A | A |
| Embodiment 18 | B | A | A | A | A |
| Embodiment 19 | B | A | A | B | B |
| Embodiment 20 | B | A | A | A | A |
| Comparison 1 | D | A | A | B | B |
| Comparison 2 | D | B | A | C | C |
| Comparison 3 | D | A | A | B | B |
| Comparison 4 | C | C | A | C | C |

TABLE 3-continued

| | Appearance | Light transmittance | RF transmittance | Film adhesion: Bending test | Film adhesion: Heat cycle test |
|---|---|---|---|---|---|
| Comparison 5 | D | A | A | D | D |
| Comparison 6 | C | D | A | D | D |
| Comparison 7 | E | B | A | C | C |
| Comparison 8 | D | D | B | D | D |
| Comparison 9 | E | B | A | D | D |
| Comparison 10 | D | C | A | D | D |

As will be known from Table 3, all timepiece dials according to the invention have an outstanding appearance and outstanding electromagnetic transparency (light and radio waves). The timepiece dial according to the invention also has outstanding coating (dispersion film) adhesion.

In contrast, satisfactory results were not obtained with the comparisons.

Timepieces as shown in FIG. 3 were also assembled using the timepiece dials according to the foregoing embodiments and comparisons. The same tests and evaluations were applied to the resulting timepieces, and the same results were obtained.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application Nos. 2010-183954, filed Aug. 19, 2010 and 2011-066241, filed Mar. 24, 2011 are expressly incorporated by reference herein.

What is claimed is:

1. A timepiece dial comprising:

a substrate that is electromagnetically transparent; and a dispersion film in which metal powder with an average particle diameter of 5 μm≦20 μm and an average particle thickness of 30 nm≦50 nm is dispersed, the average thickness of the dispersion film is 0.5 μm≦3.0 μm, and the metal powder is disposed with a specific gap therebetween in the through-thickness direction of the dispersion film.

2. The timepiece dial described in claim 1, wherein:

the average gap between the metal powders in the through-thickness direction of the dispersion film is 0.05 μm≦1.2 μm.

3. The timepiece dial described in claim 1, wherein:

the light transmittance of the timepiece dial is 10%≦40%.

4. The timepiece dial described in claim 1, wherein:

the area ratio of areas occupied by parts where the metal powder is not disposed when the timepiece dial is seen in plan view is 5%≦42%.

5. The timepiece dial described in claim 1, wherein:

at least the portion of the substrate that contacts the dispersion film is made of polycarbonate and/or acrylic resin; and the dispersion film includes acrylic resin and/or urethane resin.

6. The timepiece dial described in claim 1, further comprising:

a coating layer composed of materials including a color agent disposed to the side of the substrate that contacts the dispersion film.

7. A timepiece comprising the timepiece dial described in claim 1.

8. The timepiece described in claim 7, further comprising:

a solar cell disposed on the back side of the timepiece dial.

9. A timepiece dial manufacturing method comprising:

a substrate preparation process that prepares a substrate that is electromagnetically transparent; and a dispersion application process that applies to the substrate a dispersion in which metal powder with an average particle diameter of 5 μm≦20 μm and an average particle thickness of 30 nm≦50 nm is dispersed, and forms on the substrate a dispersion film with an average thickness of 0.5 μm≦3.0 μm in which the metal powder is disposed with a specific gap therebetween in the through-thickness direction.

10. The timepiece dial manufacturing method described in claim 9, wherein:

the dispersion application process is performed plural times.

11. The timepiece dial manufacturing method described in claim 9, wherein:

the dispersion application process is performed using a coating method.

12. The timepiece dial manufacturing method described in claim 9, wherein:

the dispersion application process applies the dispersion from a direction inclined a specific angle from the normal to the substrate surface.

13. The timepiece dial manufacturing method described in claim 12, wherein:

the specific angle is 10°≦60°.

14. The timepiece dial manufacturing method described in claim 9, wherein:

at least the portion of the substrate to which the dispersion is applied is made of polycarbonate and/or acrylic resin; and the dispersing medium of the dispersion includes one, or two or more, of a group including isopropyl alcohol, ethyl acetate, n-butyl acetate, isobutyl acetate, butyl cellosolve, and propylene glycol monomethylether acetate.

15. The timepiece dial manufacturing method described in claim 9, further comprising:

a heat process that heats the dispersion applied to the substrate after the dispersion application process.

* * * * *